US008875442B2

(12) United States Patent
Sohn et al.

(10) Patent No.: US 8,875,442 B2
(45) Date of Patent: Nov. 4, 2014

(54) METHOD AND APPARATUS OF ACTIVE DAMPENING A POWERED CLOSURE SYSTEM

(75) Inventors: John Sohn, Grosse Pointe, MI (US); Gary Bree, Clarkston, MI (US); Paul Crociata, Farmington Hills, MI (US)

(73) Assignee: Strattec Power Access LLC, Troy, MI (US)

( * ) Notice: Subject to any disclaimer, the term of this patent is extended or adjusted under 35 U.S.C. 154(b) by 43 days.

(21) Appl. No.: 13/049,583

(22) Filed: Mar. 16, 2011

(65) Prior Publication Data

US 2011/0225889 A1 Sep. 22, 2011

Related U.S. Application Data

(60) Provisional application No. 61/314,459, filed on Mar. 16, 2010.

(51) Int. Cl.

*E05F 15/00* (2006.01)
*E05F 15/12* (2006.01)
*E05F 15/20* (2006.01)

(52) U.S. Cl.

CPC ..... *E05F 15/124* (2013.01); *E05Y 2400/45* (2013.01); *E05Y 2400/326* (2013.01); *E05Y 2600/46* (2013.01); *E05Y 2400/31* (2013.01); *E05Y 2400/36* (2013.01); *E05F 15/12* (2013.01); *E05F 15/20* (2013.01); *E05Y 2400/302* (2013.01); *E05Y 2201/418* (2013.01); *E05Y 2201/21* (2013.01); *E05Y 2201/434* (2013.01); *E05Y 2900/546* (2013.01); *E05Y 2201/25* (2013.01)

USPC ..... 49/139; 49/138; 49/340; 49/506

(58) Field of Classification Search

USPC ..... 49/138, 139, 140, 339, 340, 341, 322; 296/56; 701/49

See application file for complete search history.

(56) References Cited

U.S. PATENT DOCUMENTS

| | | | | |
|---|---|---|---|---|
| 4,588,913 | A | 5/1986 | Adami | |
| 4,876,906 | A | 10/1989 | Jones | |
| 6,179,742 | B1 | 1/2001 | Haag et al. | |
| 6,640,494 | B2 * | 11/2003 | Hormann | 49/31 |
| 6,719,356 | B2 * | 4/2004 | Cleland et al. | 296/146.8 |
| 6,962,023 | B2 * | 11/2005 | Daniels et al. | 49/342 |
| 6,981,428 | B2 | 1/2006 | Donald et al. | |
| 7,071,644 | B2 * | 7/2006 | Kawanobe | 318/280 |
| 7,075,416 | B2 * | 7/2006 | Johnson et al. | 340/426.28 |
| 7,287,799 | B2 * | 10/2007 | Austin | 296/57.1 |
| 7,423,400 | B2 * | 9/2008 | Chinsen et al. | 318/466 |
| 7,578,094 | B2 * | 8/2009 | Rogers et al. | 49/138 |
| 7,681,469 | B2 | 3/2010 | Ritter | |
| 8,008,910 | B2 * | 8/2011 | Booth et al. | 324/207.2 |
| 2004/0020126 | A1 * | 2/2004 | Matsui et al. | 49/138 |
| 2008/0001563 | A1 * | 1/2008 | Kimura et al. | 318/280 |
| 2008/0061719 | A1 * | 3/2008 | Warren et al. | 318/14 |
| 2009/0044645 | A1 | 2/2009 | Buescher | |
| 2009/0206826 | A1 * | 8/2009 | Booth et al. | 324/207.2 |
| 2009/0217596 | A1 * | 9/2009 | Neundorf et al. | 49/506 |

(Continued)

*Primary Examiner* — Katherine Mitchell
*Assistant Examiner* — Abe Messad
(74) *Attorney, Agent, or Firm* — Michael Best & Friedrich LLP

(57) ABSTRACT

An actuator for moving a closure between an open and a closed position. The actuator having a first mode, where the closure is free to move with respect to a closure frame, and a second mode where the actuator resists movement between the closure and the closure frame.

11 Claims, 8 Drawing Sheets

(56) References Cited

U.S. PATENT DOCUMENTS

2009/0222174 A1* 9/2009 Frommer et al. ..... 701/49
2010/0156139 A1* 6/2010 Herrmann et al. ..... 296/146.4
2012/0090242 A1* 4/2012 Bocquet et al. ..... 49/138
2013/0060403 A1* 3/2013 Kerr ..... 701/2

* cited by examiner

METHOD AND APPARATUS OF ACTIVE DAMPENING A POWERED CLOSURE SYSTEM

CROSS REFERENCE TO RELATED APPLICATIONS

This application claims the benefit of U.S. Provisional Application No. 61/314,459, filed Mar. 16, 2010, the content of which is incorporated herein by reference in its entirety.

FIELD OF THE INVENTION

Exemplary embodiments of the present invention are generally related to closure manipulating systems. More particularly, in some exemplary embodiments, the present invention provides a closure manipulating system with dampening capabilities.

SUMMARY

Many closures (doors, liftgates, trunklids, gates) on vehicles or dwellings incorporate electronically-controlled power actuators to assist or independently power open or close the closure. These systems may also be operated manually by the consumer. During manual or power operation, the closure device may open quickly, resulting in an abrupt "bounce" when the closure reaches full open causing noise and/or excessive rebound of the closure. Many closures incorporate a type of mechanical dampening structures, such as, for example, gas shocks, to slow the liftgate during opening to ensure that the closure does not excessively recoil or stress the joints when it has reached the extent of travel. The use of mechanical dampening structures is costly, and can be difficult to calibrate once installed. The above-described and other features and advantages will be appreciated and understood by those skilled in the art from the following detailed description and drawings.

In some exemplary embodiments, an actuator extending between a closure and a closure frame is provided where the actuator is operable to move the closure between an open and a closed position. The actuator includes a base member couplable to one of the closure and the closure frame, and a drive member coupled and moveable with respect to the base member and couplable to the other of the closure and the closure frame. The actuator is operable in a first mode, where the actuator moves the closure between the open and closed positions, a second mode, where the actuator provides a first, non-zero, level of resistance to movement between the closure and the closure frame, and a third mode, where the actuator provides a second, non-zero, level of resistance, different from the first level of resistance, to movement of the closure with respect to the closure frame.

In another exemplary embodiment, an actuator extending between a closure and a closure frame of a motor vehicle is provided. The actuator includes a base member couplable to one of the closure and the closure frame, and a drive member couplable and moveable with respect to the base member and couplable to the other of the closure and the closure frame. The actuator is operable in a first mode, where the actuator displaces the drive member with respect to the base member, a second mode, where the drive member is free to move with respect to the base member, and a third mode, where the actuator resists motion between the drive member and the base member.

In another exemplary embodiment, a method of dampening the movement of a closure with respect to a closure frame is provided, the closure being moveable with respect to the closure frame between an open and a closed position. The method includes providing an actuator extending between the closure and the closure frame, and providing a sensor operable to detect the relative position of the closure with respect to the closure frame. The method also includes recording successive readings of the closure position, calculating the direction and speed of the closure from the successive readings of the closure position, comparing the closure speed to a target speed, comparing the closure position to a target range of closure positions, switching the actuator from a first mode, where the closure is free to move with respect to the closure frame, to a second mode, where the actuator resists motion between the closure and the closure frame based at least in part upon the closure speed and the direction of the closure and the closure position.

BRIEF DESCRIPTION OF THE DRAWINGS

Other objects, features, advantages and details appear, by way of example only, in the following detailed description of embodiments, the detailed description referring to the drawings in which.

DESCRIPTION OF THE EMBODIMENTS

Figure 1:
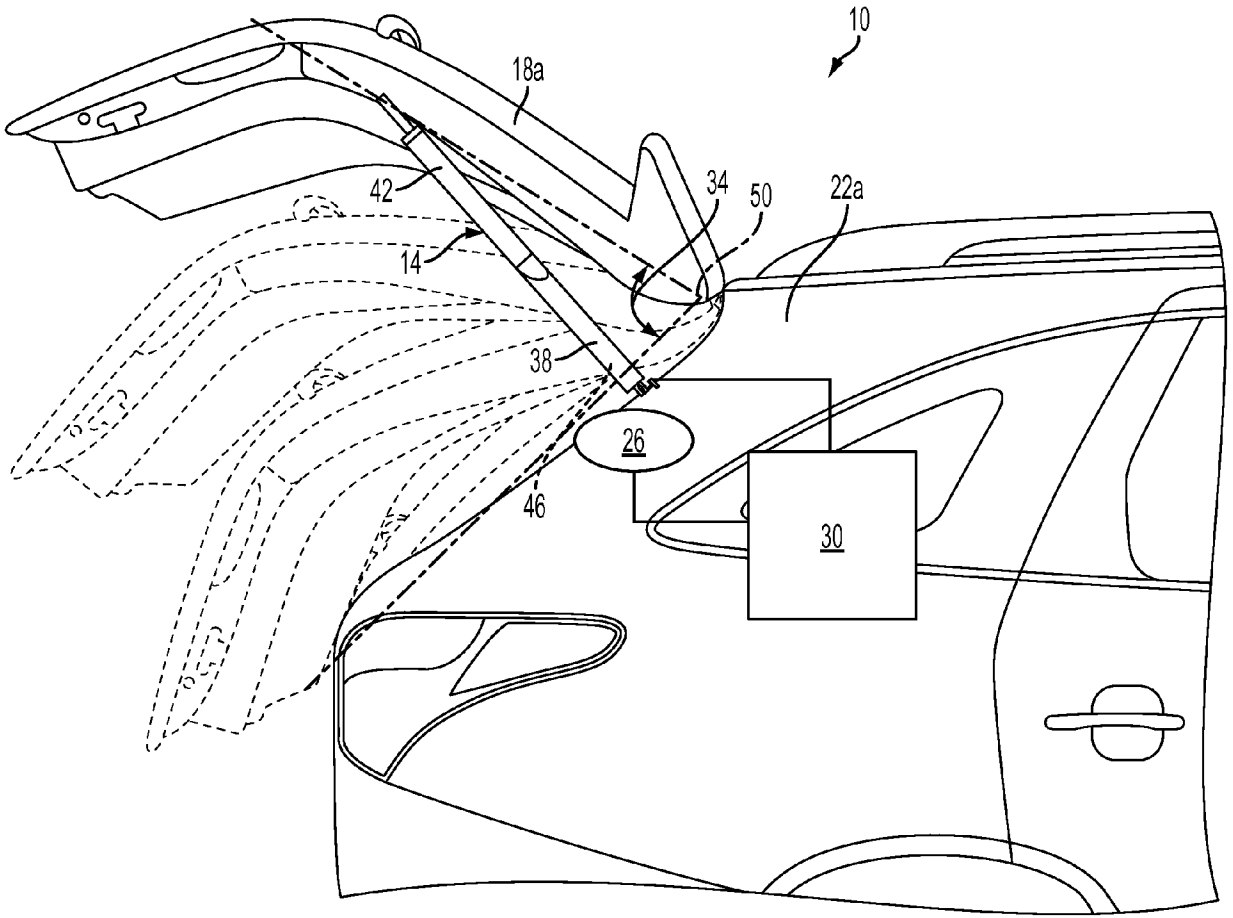
FIG. 1 is a perspective view of the closure manipulating system installed on a motor vehicle with a vehicle liftgate shown in various stages of opening.

Exemplary embodiments of the present invention provide systems and methods for manipulating closure systems. In some exemplary embodiments, the systems and methods include utilizing pulse width modulation ("PWM") duty cycles to dampen the closure system. In other exemplary embodiments, the system and method of the present invention utilizes a motor to actively dampen the motion of the closure without the need for mechanical dampening structures.

Through the above referenced features, and other features shown and described herein, the closure manipulating system of the present invention provides a system with the ability to dampen the movement of a closure during manual operation.

Referring to FIGS. 1-9, exemplary embodiments of a closure manipulating system 10 are shown. Generally, the system 10 includes an actuator 14 spanning between a closure 18 and a closure frame 22, a sensor 26 able to detect the relative position of the closure 18 with respect to the closure frame 22, and an electronic control unit 30 (ECU) operable to send and receive signals between the sensor 26, the actuator 14, and one or more user inputs (not shown). In the illustrated embodiment, the system 10 is incorporated into a motor vehicle between a car body 22*a* and a rear lift gate 18*a* pivotally mounted to the car body 22*a* to define an angle 34 therebetween (see FIG. 1). Furthermore, the illustrated embodiment includes one or more biasing members or springs 50 coupled between the liftgate 18*a* and the car body 22*a* to provide lift assistance and reduce the amount of force required to raise the liftgate 18*a*. It is to be appreciated that in alternate embodiments, the system 10 may be incorporated into additional powered door systems both linear or pivoting in nature (e.g., powered sliding doors, handicap accessible doors, actuated industrial doors, trunks, hoods, fire doors, blast doors, vault doors, and the like). In addition, the system 10 is not limited to closure type embodiments.

Figure 2:
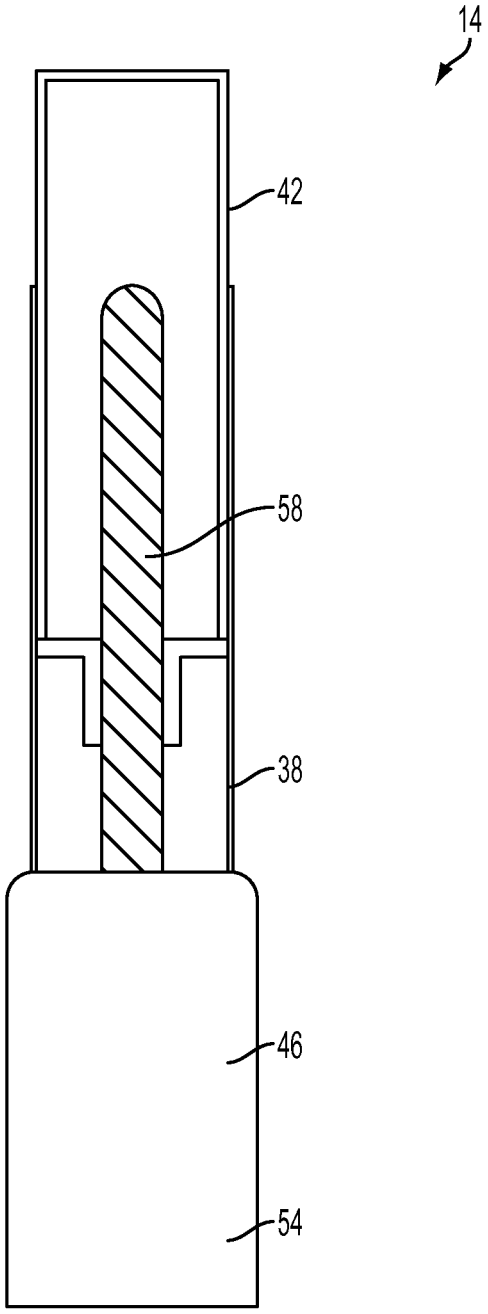
FIG. 2 illustrates an embodiment of an actuator of the closure manipulating system of FIG. 1.

Illustrated in FIG. 2, the actuator 14 of the system 10 includes a base member 38 coupled to one of the vehicle body 22*a* and the liftgate 18*a*, a drive member 42 linearly moveable with respect to the base member 38 and coupled to the other of the vehicle body 22*a* and the liftgate 18*a*. The actuator 14 also includes a motor 46 operatively coupled between the drive member 42 and the base member 38 to displace the drive member 42 with respect to the base member 38 thereby rotating the liftgate 18*a* with respect to the vehicle body 22*a*. In the illustrated embodiment, the drive member 42 displaces substantially linearly with respect to the base member 38, however in alternate embodiments, the movement of the actuator 14 may be rotational in nature. In other embodiments, the base member 38, drive member 42, and motor 46 can have other relative orientations. For example, the motor 46 can be located at an opposite end of the assembly adjacent to the liftgate 18*a*. Alternatively, the actuator 14 can include two or more separate struts with one or all of the strut assemblies including a motor 46 and with one or more of the struts providing dampening.

Figure 3:
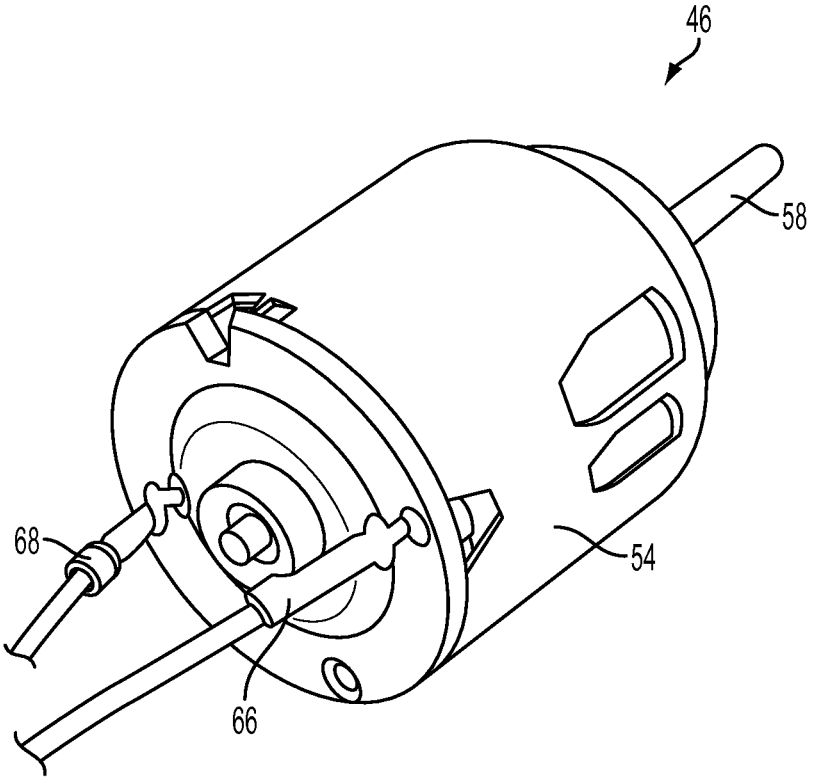
FIG. 3 illustrates an embodiment of a motor of the closure manipulating system of FIG. 1.

Best illustrated in FIG. 3, the motor 46 of the actuator 14 includes a housing 54, an armature or spindle 58 received within and rotatable with respect to the housing 54, a first input 68 operatively coupled to a first pole of the motor 46, and a second input 66 operatively coupled to a second pole of the motor 46. In the present invention, the armature 58 is operatively coupled to at least one of the drive member 42 and the base member 38 of the actuator 14. As such, rotation of the armature 58 displaces the drive member 42 from the base member 38, e.g., through use of a drive screw (not show). In alternate embodiments, the motor 46 may be directly coupled to a chain drive, cable drive, gear set and the like to provide the required movement of the system 10.

Figure 4:
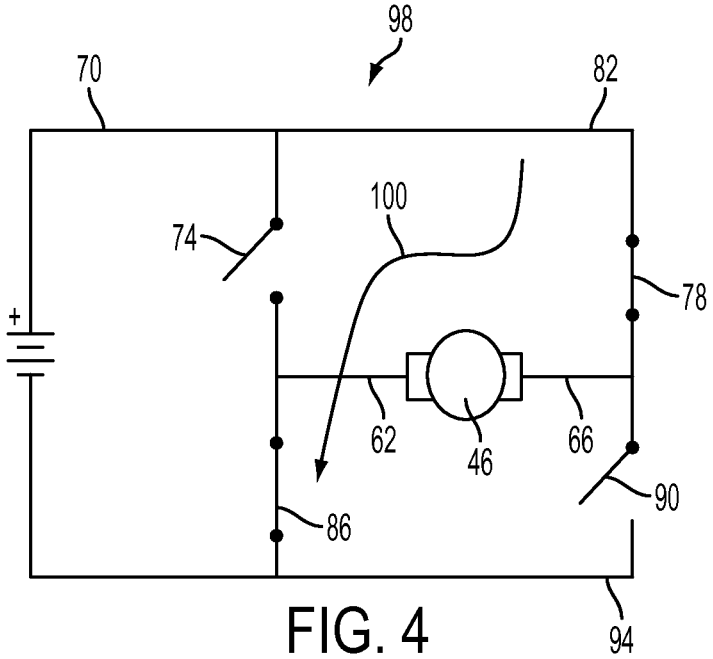
FIG. 4 is a schematic of a motor control circuit of the closure manipulating system of the closure manipulating system of FIG. 1 in a first operating mode.
Figure 5:
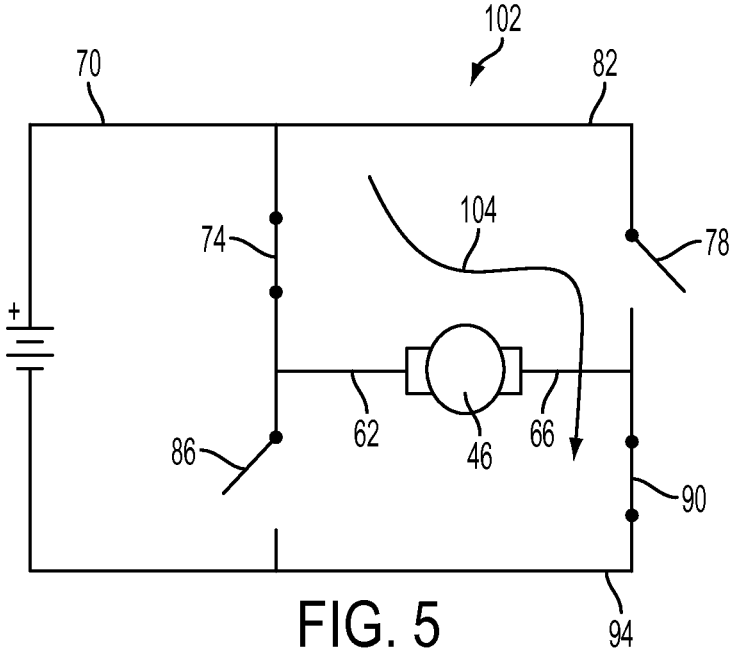
FIG. 5 is a schematic of the motor control circuit of the closure manipulating system of FIG. 1 in a second operating mode.
Figure 6:
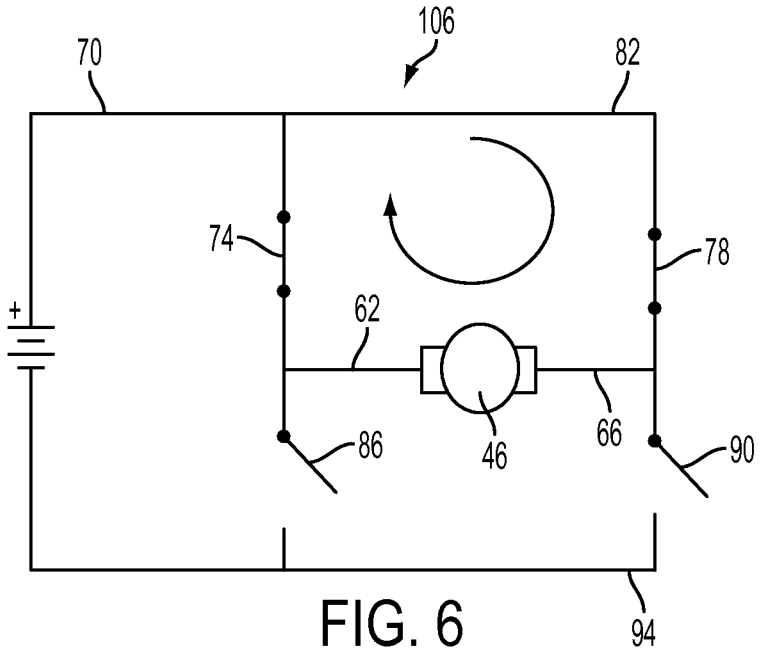
FIG. 6 is a schematic of the motor control circuit of the closure manipulating system of FIG. 1 in a third operating mode.

Electrical power is supplied to the motor 46 through an "H" bridge circuit 70 (see FIGS. 4-6). The circuit 70 includes first and second high-side FETs 74, 78 in electrical communication with a higher potential or high side 82 of the circuit 70, and first and second low-side FETs 86, 90 in electrical communication with a ground, lower potential, or low side 94 of the circuit 70. In the present invention, the first input 68 of the motor 46 is in electrical communication with the first high side and first low side FETs 74, 86 while the second input 66 is in electrical communication with the second high side and second low side FETs 78, 90.

The opening and closing of each individual FET is typically controlled by the ECU 30 and allows the circuit 70 to alter the way electrical current passes through the motor 46 to produce multiple operating modes. In a first operating mode 98 (see FIG. 4), the first high side and second low side FETs 74, 90 are opened and the second high side and first low side FETs 78, 86 are closed. As a result, in the first operating mode 98, the second input 66 is in electrical communication with the high side 82 of the circuit 70 and the first input 68 is in electrical communication with the low side 94 of the circuit 70. The resulting circuit configuration directs current through the motor 46 in a first direction 100, causing the armature 58 to rotate in a first direction with respect to the motor housing 54.

In a second operating mode 102 (see FIG. 5), the first high side and second low side FETs 74, 90 are closed and the second high side and first low side FETs 78, 86 are opened. As a result, in the second operating mode 102, the first input 68 is in electrical communication with the high side 82 of the circuit 70 and the second input 66 is in electrical communication with the low side 94 of the circuit 70. The resulting circuit configuration directs current through the motor 46 in a second direction 104, generally opposite of the first current direction 100, causing the armature 58 to rotate in a second direction with respect to the motor housing 54 substantially opposite the first direction.

In a third operating mode 106 (see FIG. 6), either both high side FETs 74, 78 or both low side FETs 86, 90 are closed with the opposing FETs being opened. As a result, the first and second inputs 68, 66 are substantially shorted, causing the motor 46 to enter an active dampening mode. In the dampening mode, the motor 46 creates a braking load or torque ($T_B$) propionate to the speed of the motor ($\omega_A$). More specifically, the braking torque ($T_B$) produced by the motor 46 is reliant upon the rotational speed of the motor's armature 58 with respect to the stator 54 ($\omega_A$), a torque constant ($K_T$), the resistance between the first and second inputs 68, 66 ($R_I$), and a speed constant ($K_S$), in a relationship defined by the equation $T_B=(\omega_A*K_T)/(R_I*K_S)$. In the illustrated embodiment, the torque constant ($K_T$) is between about 0.6, and the speed constant ($K_S$) is about 7.

Referencing FIG. 1, the sensor 26 of the system 10 is operatively coupled to the ECU 30 and detects the position of the closure 18 with respect to the closure frame 22. In the illustrated embodiment, the sensor 26 detects angle 34 and relays it to the ECU 30, typically in the form of a pre-calibrated resistance, voltage, and the like. Dependent upon the requirements and capabilities of the system 10 and the ECU 30, the sensor 26 may be active or passive in nature. Furthermore, the sensor 26 may rely upon different data collection techniques (e.g., a rheostat, a hall effect sensor, an optical sensor, a LVDT, a rotary encoder, and the like) to determine the relevant information. In specific embodiments, the sensor 26 may be integral to the actuator 14. In other specific embodiments, the system 10 may include multiple sensors collecting multiple forms of data including forces, positions, pressures, velocities, and the like.

The ECU 30 of the system 10 is operatively coupled to the actuator 14, the sensor 26, and one or more user inputs (not shown) such as toggle switches, door handles, key FOBs, and the like. The ECU 30 collects data from each of the multiple inputs to produce an appropriate output dictated by the one or more algorithms employed by the system 10 (described below). More specifically, the ECU 30 utilizes software logic to detect the conditions that may result in excessive recoil, impact, or other potentially harmful conditions and applies the appropriate countermeasures. The ECU 30 also controls and/or maintains the relative position (e.g., angle 34) between the closure 18 and the closure frame 22 through operation of the actuator 14.

The ECU 30 includes multiple operating modes, namely a first power open mode 110, and a second manual open mode 138. Typically, an input from the user, such as from a switch (not shown), will toggle the ECU 30 between the two modes.

Figure 7:
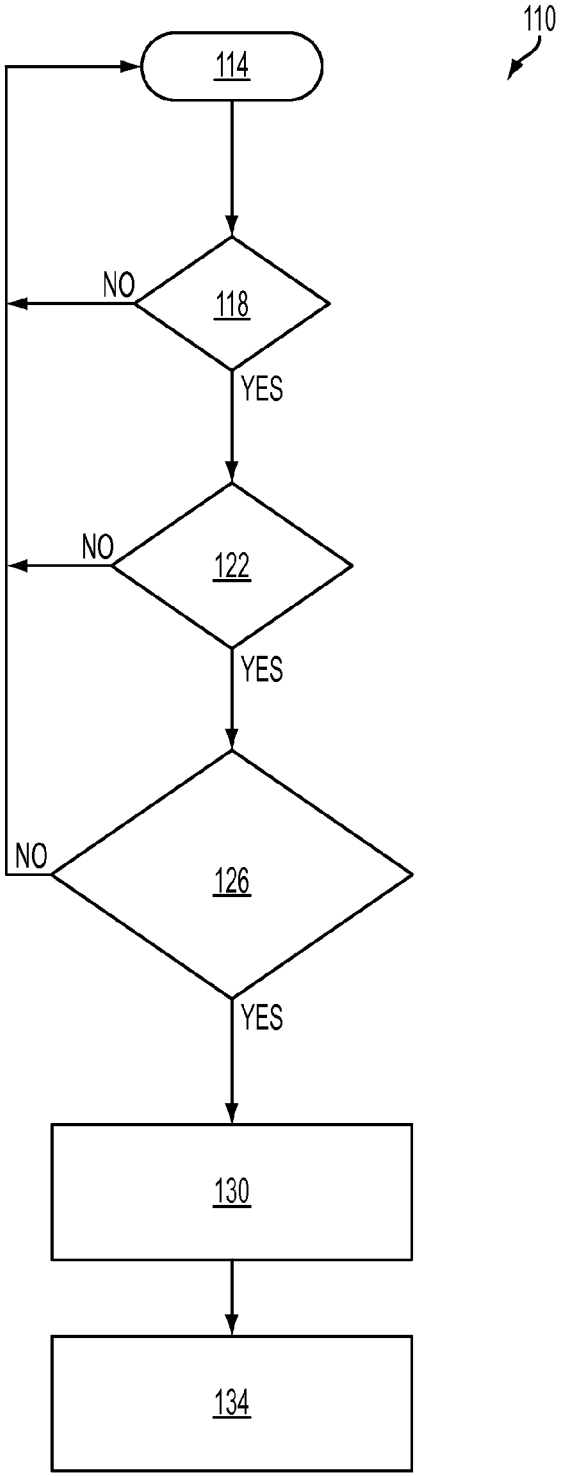
FIG. 7 is a flowchart of a power open algorithm.

When the ECU 30 is in the first power open mode 110 (see FIG. 7), an input from the user via one of the user inputs activates the sensor 26, and activates the ECU 30 to begin cycling through the power open flow diagram depicted in FIG. 7. In addition, the input from the user activates a secondary open algorithm (not shown) causing the liftgate 18*a* to automatically open the liftgate 18*a* from a substantially closed position (e.g., angle 34 is generally 0 degrees) or close the liftgate 18*a* from a substantially open position (e.g., angle 34 is generally 90 degrees).

To open the lift gate 18*a* from the closed position, at least one of the ECU 30 or the secondary algorithm opens and closes the proper FETs to place the circuit 70 into the first operating mode 98 (see FIG. 4) causing the armature 58 to rotate in the first direction and displacing the drive member 42 from the base member 38. As a result, the liftgate 18*a* rotates with respect to the car body 22*a* in a first direction causing angle 34 to increase.

With the preparatory steps completed, the ECU 30 progresses to step one 114 of the power open flowchart of FIG. 7. During step one 114, the motor 46 maintains the current operating mode of the motor 46 while monitoring inputs from the sensor 26, i.e., the motor 46 continues in the first operating mode 98.

The ECU 30 then progresses to step two 118 of the power open algorithm. During step two 118, the ECU 30 determines whether the liftgate 18*a* is opening or closing by comparing successive readings from the sensor 26. If the liftgate 18*a* is determined to be opening, the ECU 30 progresses to step three 122. However, if the liftgate 18*a* is determined to be closing, the ECU 30 regresses back to step one 114.

During step three 122, the ECU 30 compares the current gate speed A, provided by the sensor 26, to a gate speed target value B. If the current gate speed A exceeds the target value B (A>B) the ECU 30 progresses to step four 126. However, if the current gate speed A is less than or equal to the target value B (A≤B) the ECU 30 regresses back to step one 114. In the illustrated embodiment, the gate speed target value B is between 6 deg/sec and 10 deg/sec. In an alternative embodiment, the gate target speed value B is about 8 deg/sec.

During step four 126, the ECU 30 compares the current gate position C, provided by sensor 26, to a first gate position target value D, and a second gate position target valued E. During step four 126, if the current gate position C is less than first gate position target value D and greater than the second gate target value E (E<C<D), the ECU 30 progresses to step five 130. However, if either statement is not true, the ECU 30 regresses back to step one 114. In the illustrated embodiment, the first gate position target value D is defined as the liftgate 18*a* being opened between about 70% to about 90% of the overall range of motion (e.g., the current angle 34 is between about 63 to about 81 degrees when the closed position is defined as about 0 degrees and the open position is defined as about 90 degrees). Further, in the illustrated embodiment, the second gate position target value E is defined as the liftgate 18*a* being opened between about 75% to about 95% of the total range of motion (e.g., the current angle 34 is between about 68 to about 86 degrees when the closed position is defined as about 0 degrees and the open position is defined as about 90 degrees).

During step five 130, the ECU 30 loads a pulse-width modulation (PWM) duty cycle based upon the current gate speed A, and applies it to the motor 46 by manipulating the FETs as necessary. The PWM duty cycle is chosen according to the following table:

| Gate Speed A (deg/sec) | Starting PWM duty Cycle |
|---|---|
| 10-19 | 28% |
| 20-29 | 22% |
| 30-39 | 17% |

-continued

| Gate Speed A (deg/sec) | Starting PWM duty Cycle |
|---|---|
| 40-49 | 15% |
| 50-59 | 12% |
| 60-69 | 10% |
| Above 69 | 9% |

The PWM duty cycle is a percent of time the drive motor 46 is in the first or second operating mode 98, 102 over the total time of a single PWM time period. For example, with a PWM frequency of 10 kHz, the total time period for each PWM cycle is 100 μs, if the motor 46 is operating at a 60% PWM duty cycle, the circuit 70 will be in the first operating mode 98 for 60 μs and in the third operating mode (i.e., dampening) 106 for the remaining 40 μs. In another example, schematically illustrated in FIG. 9, the ECU uses a PWM duty cycle frequency of 20 kHz, meaning that the total time period for each PWM duty cycle is 50 μs. In the same example, if the motor 46 is operating at a 66% PWM duty cycle, the circuit 70 will be in the first operating mode 98 for 33 μs and in the third operating mode (i.e., dampening) 106 for the remaining 17 μs. The smaller the duty cycle rating (percentage), the longer the motor 46 is in the third operating mode 110 and the faster the deceleration of the liftgate 18*a*. By utilizing different PWM duty cycles on the motor 46, the ECU 30 is able to control the overall speed of the liftgate 18*a* as it rotates towards the open position. This allows the ECU 30 to smoothly decelerate the liftgate 18*a*, avoiding unnecessary bounce or recoil.

The ECU 30 then continues to a sixth step 134 whereby the ECU 30 varies the FET's between the two operating modes as dictated by the selected PWM duty cycle in step five 130. In some alternate embodiments, instead of altering the FET's directly, the ECU 30 may forward the selected PWM duty cycle information to a secondary algorithm to dampen the motor 46 as necessary.

In the power open mode 110, the ECU 30 continues to cycle through the above steps 114-134 until the liftgate 18*a* reaches a cycle stop position generally corresponding with the open position. With the liftgate 18*a* in the open position, the ECU 30 (and/or the secondary algorithm) opens all the FETs to deactivate the motor 46 and cease motion of the liftgate 18*a* with respect to the car body 22*a*. In the illustrated embodiment, the one or more springs 50 then support the weight of the liftgate 18*a* at the open position. In some embodiments, the ECU 30 may deactivate the sensor 26 and/or enter a "sleep" mode to conserve energy.

To close the liftgate 18*a* from the opened position, a second input is relayed to the ECU 30 via the user inputs whereby the ECU 30 opens and closes the proper FETs to place the circuit 70 into the second operating mode 102 (see FIG. 5). The second operating mode 102 causes the armature 58 to rotate in the second direction 104 displacing the drive member 42 with respect to the base member 38. As a result, the liftgate 18*a* begins to rotate with respect to the car body 22*a* in a second direction, causing angle 34 to decrease.

As the liftgate 18*a* rotates from the substantially open position to the substantially closed position, the ECU 30 cycles through the power open flow diagram in FIG. 7, as described above, until the liftgate 18*a* reaches a lower stop position substantially corresponding to the closed position. Once the liftgate 18*a* reaches the closed position, the ECU 30 may deactivate the motor 46, the sensor 26, and itself as necessary.

When the user toggles the system 10 into the manual open mode 138, the system 10 enters a stand-by mode. In the stand-by mode, the sensor 26 and ECU 30 are dormant and all the FETs are open, permitting the armature 58 to freely rotate within the housing 54. As such, the liftgate 18*a* is free to move (e.g., the system does not actively provide any resistance) with respect to the car body 22*a*. When the user actuates the door handle (not shown) to begin manually opening the liftgate 18*a*, the ECU 30 "wakes-up," activating the sensor 26. The ECU 30 then progresses to step one 142 of the manual opening mode flow diagram of FIG. 8. During step one 142, the sensor continues to monitor the position (e.g., angle 34) of the liftgate 18*a* and all the FETs remain open.

The ECU 30 then proceeds to step two 146 of the manual open flow diagram. In step two 146 the ECU 30 determines whether the liftgate 18*a* is opening or closing by comparing successive readings from the sensor 26. If the liftgate 18*a* is opening, the ECU 30 proceeds to step three 150. However, if the liftgate 18*a* is closing, the ECU 30 returns to step one 142.

During step three 150, the ECU 30 compares the current gate speed F, provided by the sensor 26, to a gate speed target value G. If the gate speed F exceeds the target value F (F>G), the ECU 30 proceeds to step four 154. However, if the gate speed F is less than or equal to the target value G (A≤B), the ECU 30 returns to step one 142. In the illustrated embodiment, the gate speed target value G is between 6 deg/sec and 10 deg/sec. In an alternative embodiment, the gate target speed value G is about 8 deg/sec.

During step four 154, the ECU 30 compares the current gate position H, provided by the sensor 26, to a first gate position target value I. During step four, if the current gate position H is greater than the first gate position target value I (H>I), the ECU 30 proceeds to step five 158. However, if the current gate position H is less than or equal to the target value I, the ECU 30 returns to step one 142. In the illustrated embodiment, the first gate position target value I is when the liftgate 18*a* has opened about 90% to about 95% of the overall range of movement (e.g., the current angle 34 is between about 81 to about 86 degrees when the closed position is defined as about 0 degrees and the open position is defined as about 90 degrees).

During step five 158, the ECU 30 opens and closes the proper FETs to place circuit 70 in the third operating mode 106 for a predetermined interval of time T. As described above, placing the circuit 70 in the third operating mode 106 produces a braking torque ($T_B$). As such, the motor 46 dampens the motion of the liftgate 18*a* for the time interval T, decelerating the liftgate 18*a* and preventing conditions that may result in excessive bounce or recoil as the liftgate 18*a* reaches the open position. In the illustrated embodiment, the predetermined interval T is about 500 msec.

The ECU 30 continues to cycle through the above steps 142-158 until the liftgate 18*a* reaches an upper stop position generally corresponding with the open position. With the liftgate 18*a* in the open position, the ECU 30 opens all the FETs to deactivate the motor 46 and cease motion of the liftgate 18*a* with respect to the car body 22*a*. In the illustrated embodiment, the one or more springs 50 substantially support the weight of the liftgate 18*a* at the open position. In some embodiments, the system 10 may return to a stand-by mode to conserve energy. In other embodiments, the system 10 may continue monitoring the position of the liftgate 18*a*.

Figure 8:
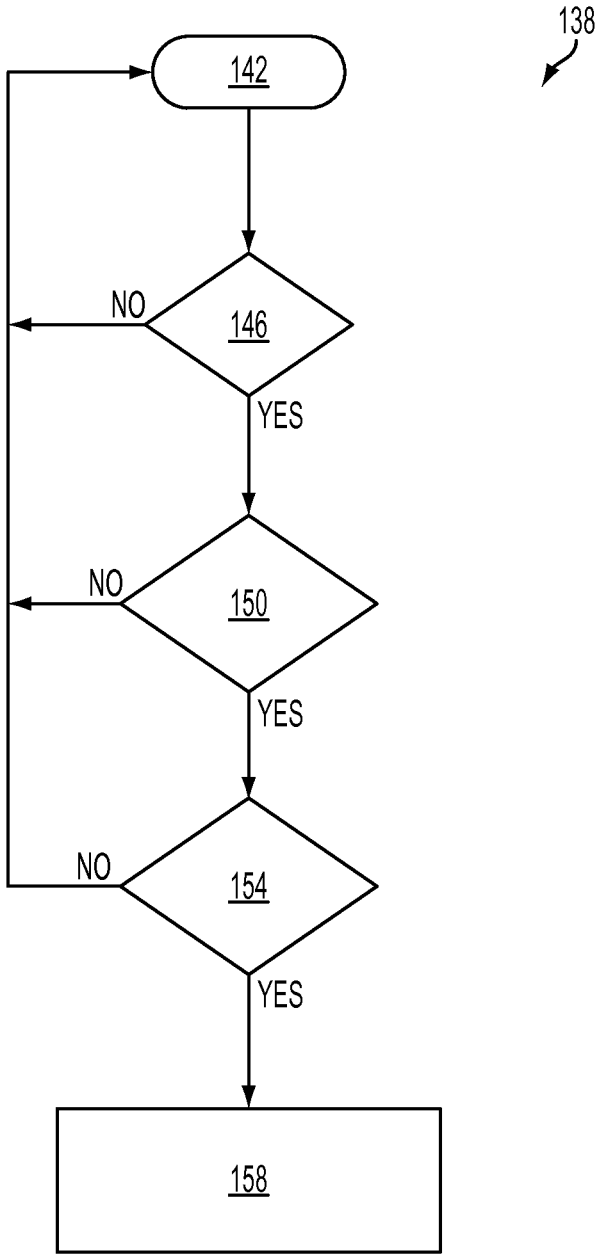
FIG. 8 is a flowchart of a manual open algorithm.
Figure 9:
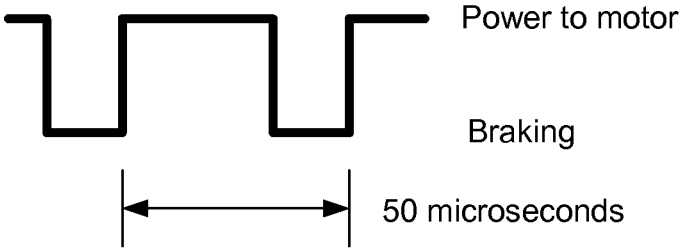
FIG. 9 is a schematic view of a PWM duty cycle.

To close the liftgate 18*a* in the manual open mode 138, the user manually closes the liftgate 18*a* while the ECU 30 cycles through the stages of the manual open flow chart of FIG. 8 as described above. In the illustrated embodiment, the system 10 does not dampen the liftgate 18*a* during closing and allows the liftgate 18*a* to slam shut, however, if necessary, the system may be altered to apply a dampening effect during the closing of the liftgate 18*a*.

It is to be understood that additional inputs, such as forces, pressures, recognition of objects within the closure, and the like may also be included as factors dictating the application of a dampening force to the liftgate 18*a* during both power and manual open modes. In addition, the target values of the system 10 may be altered dependent upon the requirements and/or capabilities of the closure and the system itself.

While exemplary embodiments have been described and shown, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. An actuator extending between a closure and a closure frame, where the actuator is operable to move the closure between an open and a closed position, the actuator comprising:

a base member couplable to one of the closure and the closure frame; and a drive member coupled to and moveable with respect to the base member and couplable to the other of the closure and the closure frame, wherein the actuator is operable in a first power mode, where the actuator automatically moves the closure between the open and closed positions in response to a signal from the user, and a second, non-driven manual mode, where the actuator actively monitors the movement of the closure with respect to the closure frame and provides varying non-zero levels of active dampening based at least in part on the position of the closure with respect to the closure frame, the direction of travel of the closure, and the speed of the closure with respect to the closure frame while remaining in the second, non-driven manual mode, wherein in the second, non-driven manual mode, the varying non-zero levels of active dampening are provided over the entirety of an arc of movement defined between the open and closed positions.

2. The actuator of claim 1, wherein in the second, non-driven manual mode the level of active dampening is proportionate to the relative speed of the closure with respect to the closure frame.

3. The actuator of claim 1, wherein in the second, non-driven manual mode the actuator provides active dampening when the closure is positioned proximate at least one of the open and closed positions.

4. The actuator of claim 1, wherein in the second, non-driven manual mode the actuator provides active dampening when the speed of the closure with respect to the closure frame exceeds a predetermined limit.

5. The actuator of claim 1, wherein in the second, non-driven manual mode the actuator provides active dampening when the closure is opening with respect to the closure frame and does not provide active dampening when the closure is closing with respect to the closure frame.

6. A method of dampening the movement of a closure with respect to a closure frame, the closure being moveable with respect to the closure frame between an open and a closed position, the method comprising:

providing the actuator of claim 1, the actuator extending between the closure and the closure frame;

providing a sensor operable to detect the relative position of the closure with respect to the closure frame;

recording successive readings of the closure position;

calculating the direction and speed of the closure from the successive readings of the closure position;

comparing the closure speed to a target speed;

comparing the closure position to a target range of closure positions;

switching the actuator from a non-dampening mode, where the closure is free to move with respect to the closure frame, to a dampening mode, where the actuator resists motion between the closure and the closure frame based at least in part upon the closure speed and the direction of the closure, and the closure position.

7. The method of claim 6, wherein switching the actuator from the non-dampening mode to the dampening mode occurs when the closure speed has exceeded the target speed.

8. The method of claim 7, wherein the target speed is about 8 deg/sec.

9. The method of claim 6, wherein switching the actuator from the non-dampening mode to the dampening mode occurs when the closure is positioned outside the target range.

10. The method of claim 9, wherein the closure is positioned outside the target range when the closure is positioned proximate at least one of the open and the closed positions.

11. The method of claim 6, further comprising switching the actuator to a powered mode, where the actuator displaces the closure with respect to the closure frame.

* * * * *